United States Patent [19]

Pere et al.

[11] 4,396,484

[45] Aug. 2, 1983

[54] ELECTROLYZER WITH TEMPERATURE-STABLE FRAME STRUCTURE

[75] Inventors: Gérard Peré; Michel Largy, both of Le Breuil, France

[73] Assignee: Creusot-Loire, Paris, France

[21] Appl. No.: 339,591

[22] Filed: Jan. 15, 1982

[30] Foreign Application Priority Data

Feb. 24, 1981 [FR] France ..... 81 03592

[51] Int. Cl.[3] ..... C25B 9/00; C25B 13/00

[52] U.S. Cl. ..... 204/257; 204/279

[58] Field of Search ..... 204/253-258, 204/279

[56] References Cited

U.S. PATENT DOCUMENTS

| | | | |
|---|---|---|---|
| 4,069,129 | 1/1978 | Sato et al. | 204/279 X |
| 4,257,866 | 3/1981 | Belle et al. | 204/279 X |
| 4,274,939 | 6/1981 | Bjäreklint | 204/279 X |
| 4,315,811 | 2/1982 | Kircher | 204/279 |

*Primary Examiner*—Donald R. Valentine

*Attorney, Agent, or Firm*—Pollock, Vande Sande & Priddy

[57] ABSTRACT

An electrolyzer cell of the filter-press type intended to operate under high pressure and at high temperature is constructed of spacing frames (4) for supporting and joining the electrodes and the diaphrams (1). Each frame is constituted by several portions (41 to 44), each held at a fixed point (61 to 64) and slidingly joined to one another.

5 Claims, 5 Drawing Figures

ELECTROLYZER WITH TEMPERATURE-STABLE FRAME STRUCTURE

FIELD OF THE INVENTION

The present invention relates to the construction of an electrolyzer of the filter-press type, and more particularly to an electrolyzer intended to operate under high pressure and at high temperature, for example, the electrolyzer which is the subject of French Pat. No. 2.448.583.

An electrolyzer of the filter-press type is generally constituted by a pile of several hundred elementary electrolysis cells, this pile being in the form of an alternating succession of electrodes and diaphragms bounding spaces in which the electrolyte flows. In an equally conventional way and in order to obtain maximum power, this pile is positioned in a sealed enclosure filled with an inert gas and, during operation, raised to high pressure and temperature.

The temperature inside the pressurized enclosure can vary, as a function of the operating cycles, by considerable amounts, e.g., of the order of 160° C. during operating hours and 20° C. during resting hours. Since the pile of cells is assembled at the ambient temperature, it is necessary for the geometric shapes of the initial pile to be retained at working temperature despite expansion due to the temperature rise, so as to assure that the electrolyzer operates properly at its operating temperature. The electrodes are generally made of metallic material, generally nickel, with a low expansion coefficient. Similarly, the diaphragms are constituted by either a sheet of asbestos or a rep made of nickel or "TEFLON" material with a low expansion coefficient, and are often mounted in a rigid frame made of nickel or other material which also expands very little. However, it has proved necessary, in order to provide resistance to corrosion due to the electrolyte, to constitute the insulating connections forming spacer and joint between electrodes and diaphragms by frames made of a material which resists corrosion well, such as a polymer containing fluorine, possibly loaded with nickel or asbestos, for example polytetrafluorethylene termed P.T.F.E. Though it has excellent qualities such as providing sealing, electrical insulation, and resistance to corrosion, this type of material unfortunately has the disadvantage of expanding five to ten times more than the other constituent materials of the pile so that, in the case where diaphragms not mounted in a nickel frame are used, it has been found that many tears are produced in the diaphragms and in addition, the pile fails in all instances to retain its initial geometric shape, so that electrolyzer performance is considerably affected.

SUMMARY OF THE INVENTION

The present invention allows these problems to be solved. The electrolyzer of the filter-press type which is the subject thereof is equipped with spacing frames each constituted by at least two frame-portions, each of these portions having a fixed point and being joined slidingly to the adjacent portion or to two adjacent portions.

BRIEF DESCRIPTION OF THE DRAWINGS

The invention will be better understood from the following description of a preferred embodiment, applied to the construction of an electrolyzer such as that to which the above-mentioned French patent relates, with reference to the attached drawings, in which.

DETAILED DESCRIPTION OF AN EMBODIMENT

Figure 1:
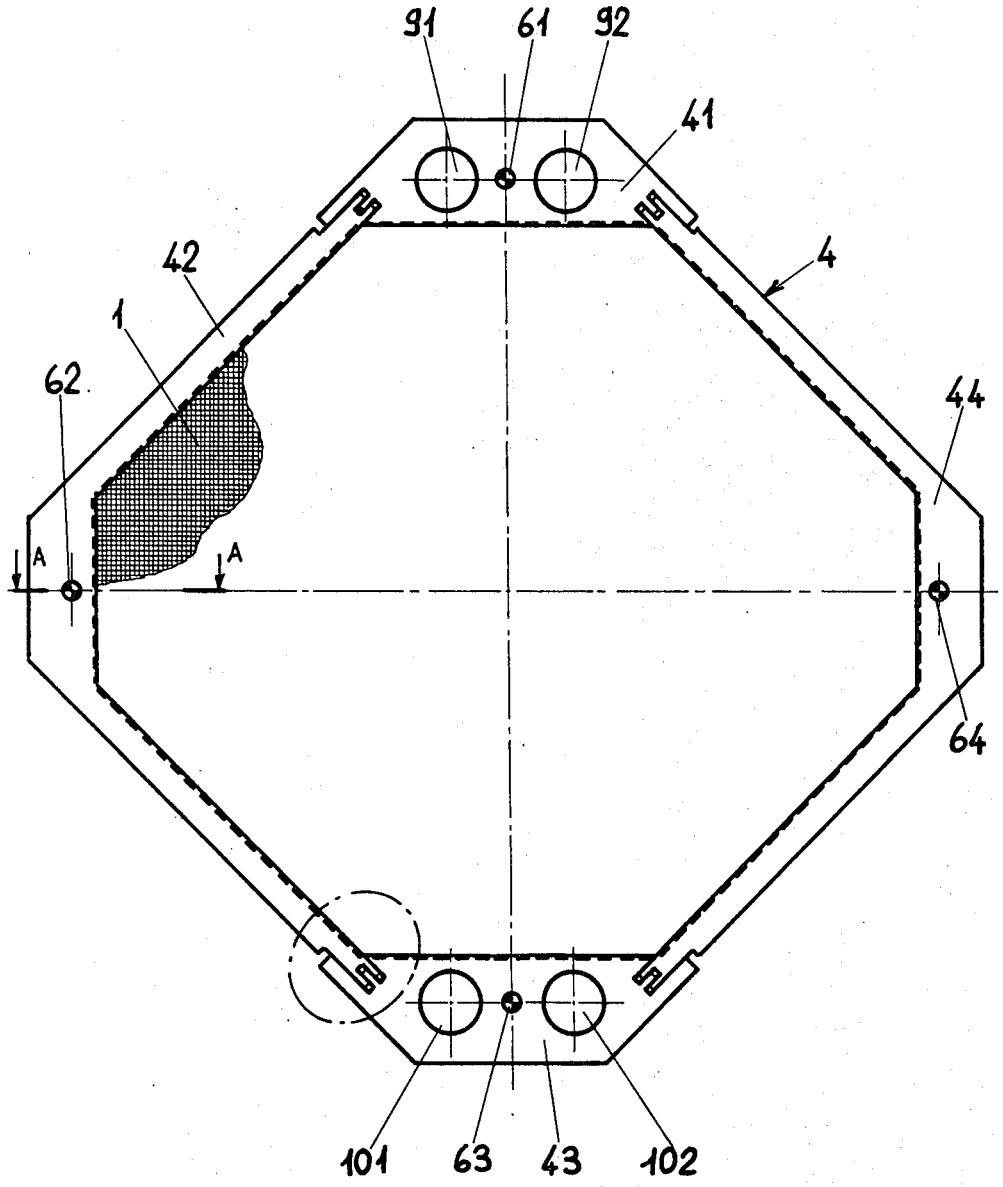
FIG. 1 is a diagrammatic view in transverse section of the electrolyzer of the invention, taken at the level of a diaphragm.
Figure 2:
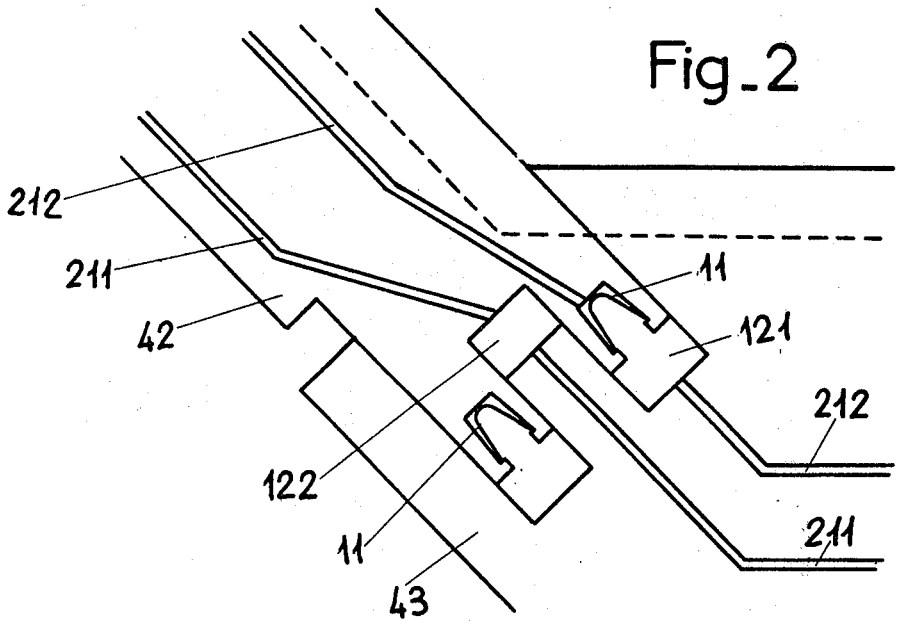
FIG. 2 is an enlarged view of the detail ringed with a chain-dotted line in FIG. 1.
Figure 3:
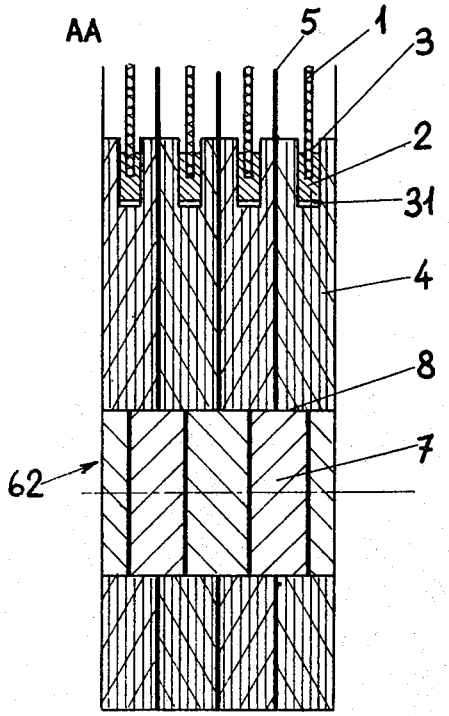
FIG. 3 shows, in partial section in the direction A—A of FIG. 1, a first embodiment of a fixed point, FIG. 4 also shows a second embodiment of a fixed point.

With reference first to FIGS. 1 to 3, the electrolyzer of the invention is equipped with diaphragms 1 made of nickel rep, each mounted in a rigid frame 2, also made of nickel. Each frame 2 is engaged so that it can slide in a corresponding recess 3 cut in the spacer frame 4 made of PTFE which, in an entirely conventional manner, serves both as joint and support for the electrodes 5 and the diaphragm 1.

As FIG. 1 shows, each spacing frame 4 is constituted by four portions (41, 42, 43, 44) which are mounted end to end so as to form the said frame, by means of sliding assemblies, the one ringed with a chain-dotted line at the bottom left of FIG. 1 being represented in more detail and by way of example in FIG. 2. Also, at its median part, each frame portion is provided with a fixed point, respectively 61, 62, 63, 64, which acts to prevent any deformation at this point by expansion of the frames 4 with respect to the electrodes 5.

For example, as FIG. 3 shows, a fixed point 62 is constituted by a set of discs 7 made of nickel forcibly fitted in a passage 8 which has been previously pierced longitudinally in the pile of cells.

In the example concerned, the fixed points 61 and 63 are respectively located between the discharge passages 91 and 92 and the supply passages 101 and 102, and the fixed points 62 and 63 are located respectively at two other angles of the square formed by a frame 4.

In the enlarged view of FIG. 2, in particular, it can be seen that two successive frame portions (42 and 43) are fitted slidingly one inside the other. Also, so as to complete sealing where they join, springs 11 are positioned, as FIG. 2 shows, so as to open out the male, U-shaped ends of the portion 42 by pressing these against the corresponding female walls of the portion 43. FIG. 2 shows, lastly, that it is possible to make the electrolyzer of the invention, in conformance with the teaching of the above-mentioned French patent, by providing its frames 4 with "distributor" grooves 212 and "collector" grooves 211 using the terms and references of the said patent, the "distributor" grooves 212 being supplied with demineralized water, as is explained in detail in the said French Patent. The connection between the successive sections of a groove 212 or 211 is then made, respectively, by means of spaces 121 and 122 for sliding, as represented in the drawing. The construction according to FIGS. 1 to 3 thus prevents any differential expansion from occurring between the frames 4 and the electrodes 5, at the location of the fixed points 61 to 64. The frame portions 41 to 44 thus expand by sliding one inside the other so that the geometric shape of each frame 4 is retained. To obtain this result, care must be taken to make the frame portions, such as 42 and 43, in such a way that, at ambient temperature, spaces for sliding, such as 121 and 122, are left between them, which are sufficient to allow sliding up to maximum operating temperatures.

Also, as FIG. 3 shows, the rigid frames 2 are fitted into the recesses 3 so as to leave sufficient space 31 for sliding at ambient temperature.

Figure 4:
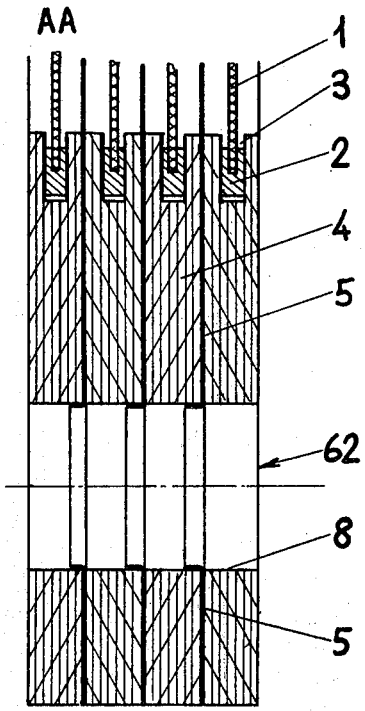

The fixed points such as 62 can be made in a different way from that described with reference to FIG. 3. They can each be quite simply constituted, for example, by a screw and nut assembly or, as represented in FIG. 4, quite simply made by riveting by means of the electrodes 5 themselves, the electrodes then being slightly bent back along the orifice 8 so as to hold the frames 4 firmly.

The embodiment just described with reference to FIGS. 1 to 4 relates mainly to an electrolyzer equipped with small cells, 50 cm a side, for example. When larger frames are used, whose sides can be, for example, of the order of 150 cm, it is preferable to provide the pile with frames each constituted by more than four portions sliding one inside the other, each of these portions also being equipped with a fixed point preferably located in its median plane.

Figure 5:
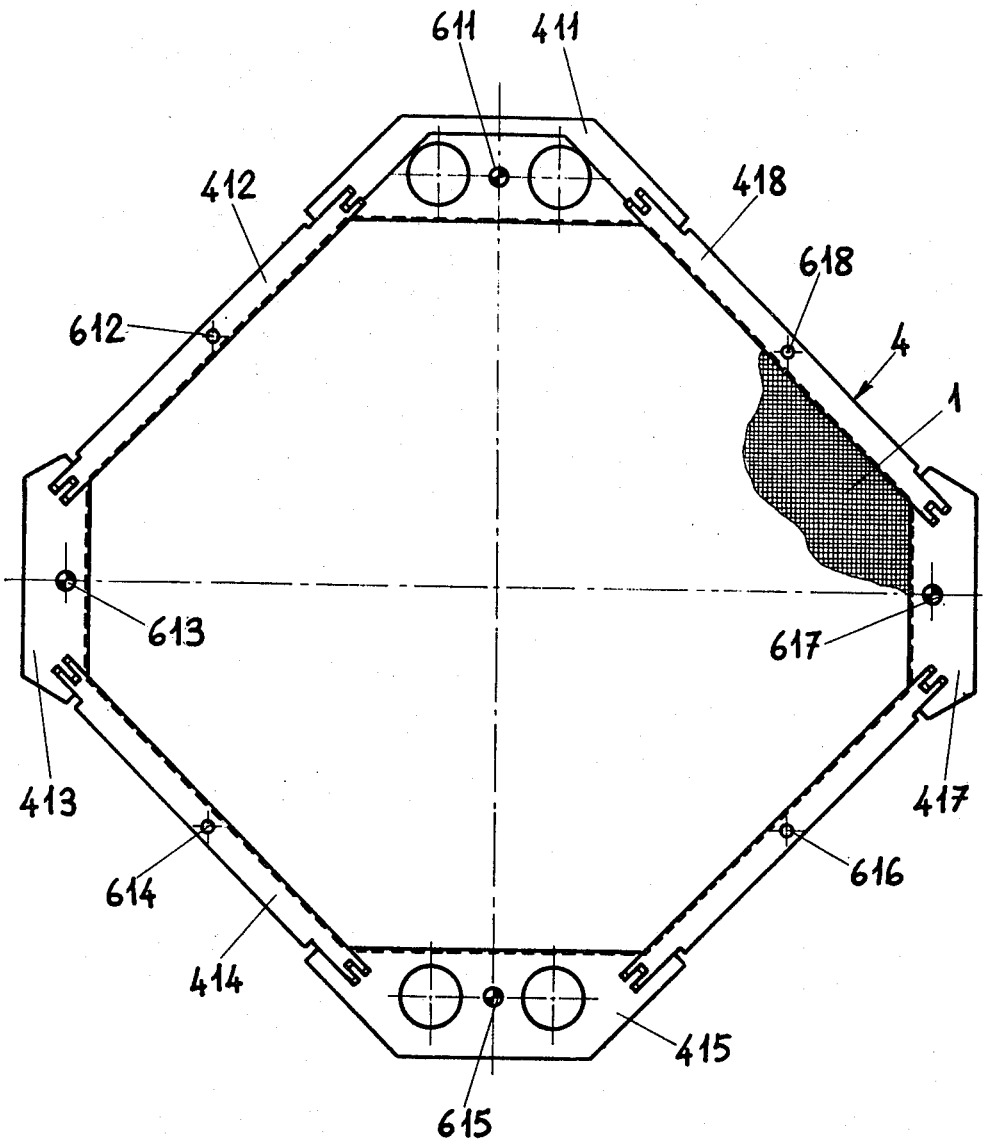
FIG. 5 is a transverse diagrammatic section of a further embodiment, intended to be applied to a very large electrolyzer.

FIG. 5 represents an embodiment of such a larger electrolyzer. As the drawing shows, each frame 4 is constituted by eight sliding portions 411 to 418, each of these portions being provided in its median plane with a fixed point, respectively 611 to 618. In the case of even larger frames, each of these can be constituted by a number of sliding portions, which can be 12 or more with a fixed point according to the invention.

We claim:

1. Electrolyzer of the filter-press type, comprising spacing frames for supporting and joining electrodes and diaphragms, each of said frames being constituted by at least two portions assembled together for relative longitudinal sliding movement to accommodate expansion resulting from temperature changes, each of said portions including a fixed point for preventing deformation thereat upon expansion of said frames with respect to said electrodes.

2. Electrolyzer according to claim 1, wherein the said fixed point is located in the median plane of the corresponding frame portion.

3. Electrolyzer according to claim 1 or 2, of the type equipped with diaphragms mounted in a rigid frame, wherein each rigid frame is mounted slidingly in a recess of the corresponding spacing frame.

4. Electrolyzer according to claim 1, comprising sealing elements in said sliding connections.

5. Electrolyzer according to claim 1 or 2, of the type provided with distributor and collector grooves, wherein the connection between successive sections of said distributor and collector grooves is effected through spaces for permitting relative sliding movement between the two corresponding frame portions upon expansion thereof.

* * * * *